United States Patent [19]

Shibayama et al.

[11] Patent Number: 4,501,224

[45] Date of Patent: Feb. 26, 1985

[54] CONTINUOUS TAG PRINTING APPARATUS

[75] Inventors: Tooru Shibayama, Kanagawa; Hiroshi Kajiya, Tokyo; Mitsuharu Takahashi, Kanagawa, all of Japan

[73] Assignee: Kabushiki Kaisha Sato, Japan

[21] Appl. No.: 507,698

[22] Filed: Jun. 24, 1983

[30] Foreign Application Priority Data

Jun. 29, 1982 [JP] Japan ..... 57-110763

[51] Int. Cl.[3] ..... B05C 1/02; B05C 1/16

[52] U.S. Cl. ..... 118/697; 118/40; 118/46; 118/236; 118/241; 101/66

[58] Field of Search ..... 118/46, 236, 241, 40, 118/697, 698; 101/66

[56] References Cited

U.S. PATENT DOCUMENTS

| | | | |
|---|---|---|---|
| 3,253,544 | 5/1966 | Von Hofe | 101/66 X |
| 3,861,351 | 1/1975 | Bonwit et al. | 118/236 X |
| 4,106,432 | 8/1978 | Gunther, Jr. | 118/236 X |

*Primary Examiner*—John P. McIntosh

*Attorney, Agent, or Firm*—Ostrolenk, Faber, Gerb & Soffen

[57] ABSTRACT

A continuous tag printing apparatus is disclosed wherein a strip of tags is not wasted, and cut tags are easily aligned. The continuous tag printing apparatus has a feed mechanism for feeding the strip, a printing mechanism for printing desired information on the strip, and a mark applying mechanism for applying a mark on a side surface of a portion of the strip, which portion corresponds to a partition tag which indicates a change in printing contents.

10 Claims, 9 Drawing Figures

CONTINUOUS TAG PRINTING APPARATUS

BACKGROUND OF THE INVENTION

1. Field of the Invention

The present invention relates to a continuous tag printing apparatus. More specifically, the present invention relates to a continuous tag printing apparatus for performing printing on a strip of tags, such as price tags, and for simultaneously providing a partition tag so as to distinguish a set of tags printed with one type of information from another set of tags printed with a different type of information.

2. Description of the Prior Art

In general, the information to be printed by a continuous tag printing apparatus may often change every predetermined number of tags. After printing, the strip of printed tags is cut into individual tags which are then stacked for use as needed. When the printing contents change every predetermined number of printed tags to be cut and stacked, it is convenient to sandwich a partition tag between sets of tags printed with different information so as to readily distinguish one set of tags from another set of tags.

As a result of the foregoing, partition tags are conventionally formed as shown in FIG. 1. Every time the information printed on a strip 1 of regular tags 2 changes, two non-regular tags 2*a* and 2*b* having different lengths than the regular tags and having different lengths from each other are formed between the regular tags. A cutting position C′ which differs from a predetermined cutting position C is set between the tags 2*a* and 2*b*. The strip 1 is cut at the cutting position C′ so as to obtain the short tag 2*a* and the long tag 2*b*. In this manner, since the short and long tags 2*a* and 2*b* are sandwiched between the regular tags every time the information being printed changes, the change in information can be readily checked even after the tags are stacked as shown in FIG. 2.

However, when the partition tags are formed as described above, the portion of the strip 1 which corresponds to two tags is wasted. Furthermore, since the regular tags 2 have a length different from those of the tags 2*a* and 2*b*, it is inconvenient to stack the cut tags which have different lengths in a stacker or to align them manually.

BRIEF SUMMARY OF THE INVENTION

It is, therefore, an object of the present invention to eliminate the conventional drawback described above.

It is another object of the present invention to provide a continuous tag printing apparatus which does not waste a strip of tags and which provides a partition tag which may be readily aligned with regular tags.

It is still another object of the present invention to provide a new, simple, continuous tag printing apparatus which is easily operated.

In order to achieve the above and other objects of the present invention, there is provided a continuous tag printing apparatus comprising a feed mechanism for continuously feeding a strip of tags, a printing mechanism for printing desired information on each tag, and a mark applying mechanism for applying a mark on a side surface of a portion of the strip, which portion corresponds to a portion at which the information being printed changes.

BRIEF DESCRIPTION OF THE DRAWINGS

The foregoing and other objects of the present invention will become more apparent from the following description of a preferred embodiment taken in connection with the accompanying drawings, in which:

FIGS. 3 to 9 show a continuous tag printing apparatus according to an embodiment of the present invention, in which FIG. 3 is a schematic side view showing the overall construction thereof;

FIG. 4 is a plan view showing the step wherein a mark is applied to a side surface portion of a strip of tags;

FIG. 5 is a perspective view showing the structure of a mark applying mechanism;

FIG. 6 is a perspective view showing a stack of cut tags;

FIG. 7 is a block diagram of a drive circuit;

FIG. 8 shows an input data format; and

FIG. 9 is a flow chart for explaining the mode of operation of the drive circuit.

DETAILED DESCRIPTION OF THE PREFERRED EMBODIMENT

A continuous tag printing apparatus according to an embodiment of the present invention will be described with reference to the accompanying drawings.

Figure 1:
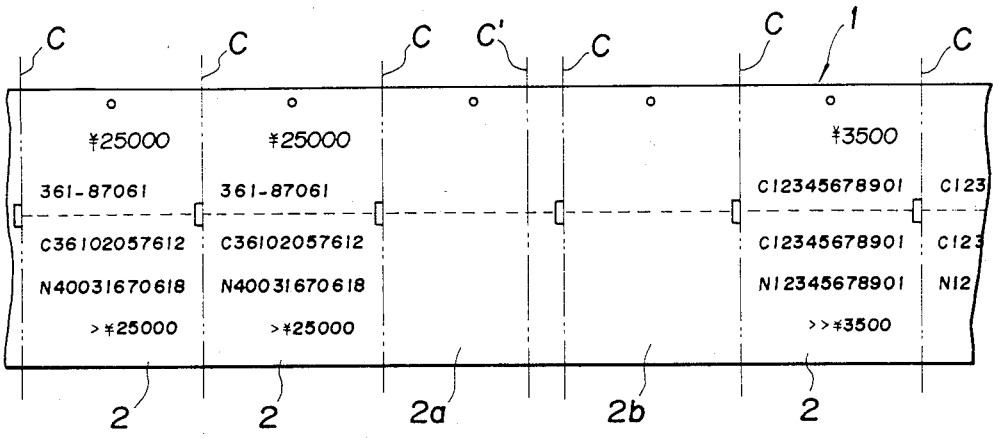
FIG. 1 PRIOR ART
FIG. 1 is a plan view of partition tags of a conventional strip of tags.
Figure 2:
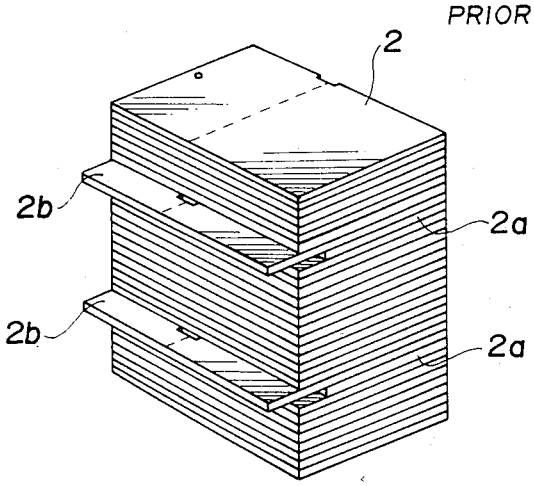
FIG. 2 PRIOR ART
FIG. 2 is a perspective view showing a stack of cut regular and partition tags shown in FIG. 1.
Figure 3:
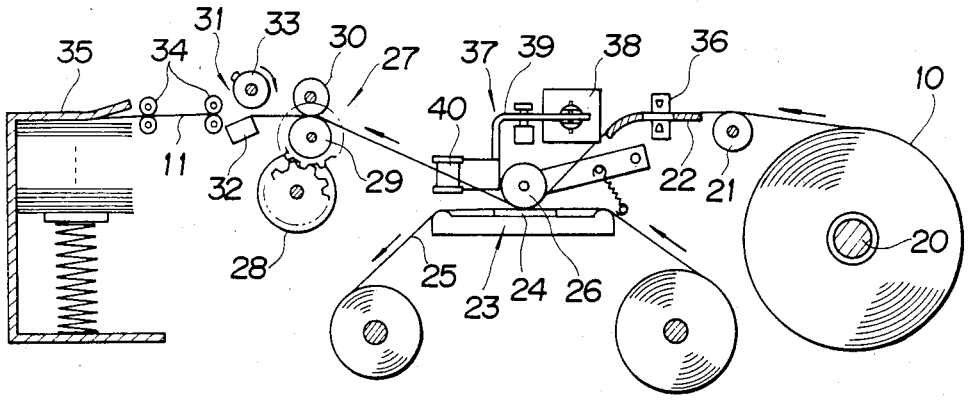

Referring to FIG. 3, a strip 10 of tags 11 (FIG. 4) which is made of thick paper is wound around a supply roller 20 and is fed to a printing mechanism 23 through a guide roller 21 and a guide plate 22. The printing mechanism 23 has a thermal printing head 24. A platen roller 26 is brought into tight contact with the thermal printing head 24 through the strip 10 and a heat-sensitive transfer carbon ribbon 25. While a thermal printing system is disclosed, the present invention may be used with any type of printing system such as electrostatic, ink-jet and drum impact systems.

Figure 4:
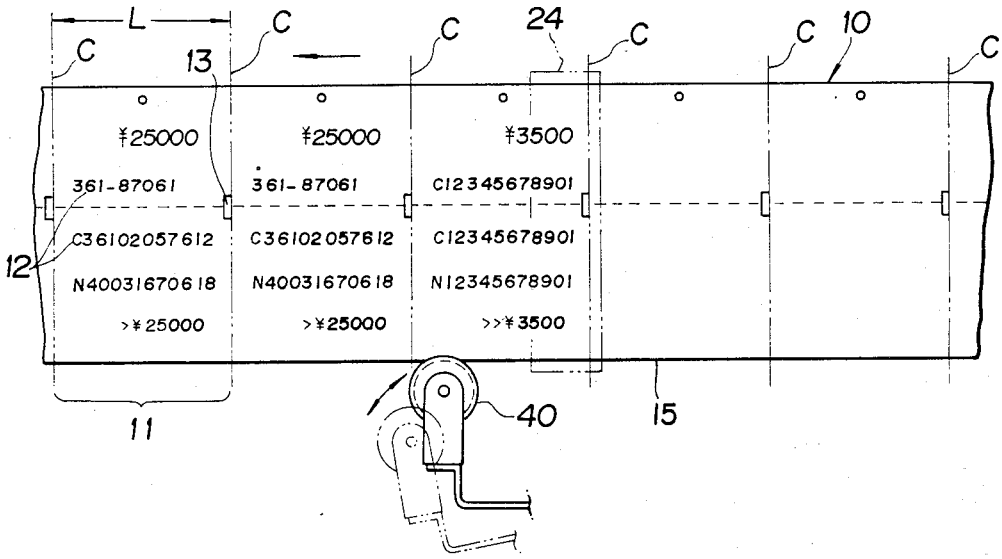

The strip 10 on which desired information 12 shown in FIG. 4 has been printed by the printing mechanism 23 is guided to a feed mechanism 27. The feed mechanism 27 has a driving roller 29 driven by a pulse motor 28, and a driven roller 30. The strip 10 is then fed from the feed mechanism 27 as needed.

The strip 10 passing through the feed mechanism 27 is sequentially cut by a stationary blade 32 and a rotary blade 33 of a cutting mechanism 31 at each cutting position C indicated by an alternate long and two dashed lines in FIG. 4, thereby obtaining individual tags 11. The tags 11 are sequentially fed by delivery rollers 34, which are continuously rotated, and are stacked in a stacker 35.

A transmission type photoelectric sensor 36 mounted on the guide plate 22 detects apertures 13 (FIG. 4) associated with each of the tags of the strip 10 and generates an output signal in reponse thereto. The timing of the printing and cutting operations are set in accordance with the output signal.

A mark applying mechanism 37 is disposed between the printing mechanism 23 and the feed mechanism 27 so as to apply a mark on the side surface 15 of a portion of the strip 10. This portion corresponds to a partition tag at which the information being printed changes.

The mark applying mechanism 37 mainly comprises a solenoid 38, a lever 39 and an ink roller 40.

Figure 5:
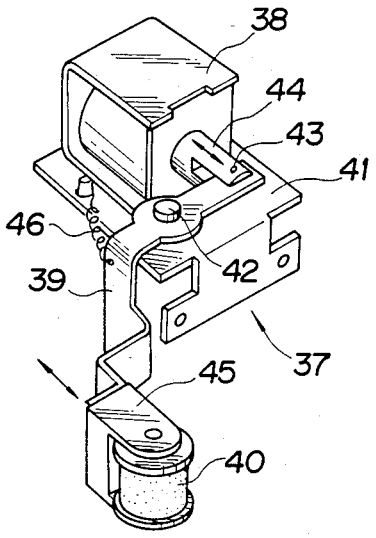

As shown in FIG. 5, the solenoid 38 is mounted on a base plate 41 which is in turn mounted on an apparatus housing (not shown). The lever 39 is pivoted about a pivot pin 42. One end of the lever 39 is pivotally mounted by a pin 43 to a plunger 44 of the solenoid 38, and the other end thereof has a support frame 45 for rotatably supporting the ink roller 40. The lever 39 is biased by a spring 46 in a direction to separate the ink roller 40 from the strip 10. The spring 46 is hooked between the base plate 41 and the lever 39.

When the solenoid 38 of the mark applying mechanism 37 is energized, the lever 39 is pivoted counterclockwise in FIG. 5. As a result, the ink roller 40 is brought into tight contact with the side surface of the strip 10 as shown in FIG. 4 so as to apply a mark thereon to identify a partition tag. However, when the solenoid 38 is de-energized, the lever 39 is pivoted clockwise (FIG. 5) to separate the ink roller 40 from the strip 10 as indicated in phantom in FIG. 4. It should be noted that the ink roller 40 is brought into oblique, tight contact with the strip 10 as shown in FIG. 3 so as to prevent partial wear of the roller 40 and to provide smooth rotation thereof.

Figure 7:
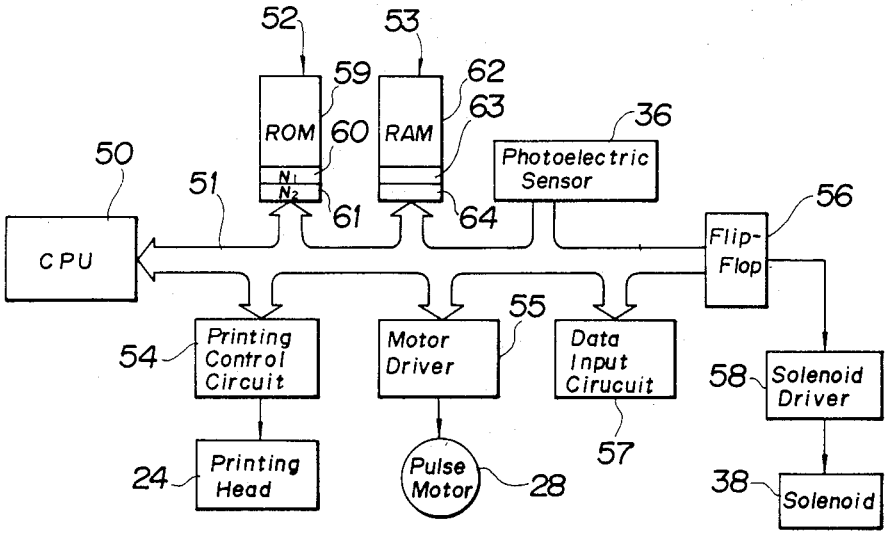

The arrangement of the drive circuit of the continuous tag printing apparatus of the present invention will now be described. Referring to FIG. 7, a CPU (central processing unit) 50 is connected to a ROM (read-only memory) 52 and a RAM (random access memory) 53 through a common bus 51. The ROM 52 has a program memory area 59 and permanent memory areas 60 and 61 store fixed reference values $N_1$ and $N_2$, respectively, for controlling the solenoid 38. The RAM 53 has a printing data memory area 62, a tag counter 63 for counting the number of tags 11, and a step counter 64 for counting the number of steps of the pulse motor 28.

The photoelectric sensor 36, a printing control circuit 54, a motor driver 55, a flip-flop 56 and a data input circuit 57 are also connected to the common bus 51. The printing control circuit 54 serves to control the printing head 24 for printing information on the strip 10. The motor driver 55 drives the pulse motor 28. A solenoid driver 58 which receives an output signal from the flip-flop 56 serves to energize the solenoid 38 while the flip-flop 56 is set.

Figure 8:
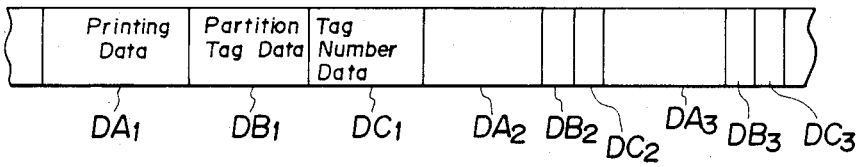

Data supplied from the data input circuit 57 is stored in the printing data memory area 62. A data format of the printing data memory area 62 is shown in FIG. 8. Referring to FIG. 8, printing data $DA_1$ indicating a first type of printing information to be printed on tags 11, a 1-bit partition tag data $DB_1$ indicating whether or not a partition tag is to be formed, and tag number data $DC_1$ indicating the number of tags to be printed with the first type printing information are sequentially stored in the memory area 62. Subsequently, printing data $DA_2$ indicating a second type of printing information to be printed on tags 11, partition tag data $DB_2$ corresponding to the printing data $DA_2$, and tag number data $DC_2$ corresponding thereto are stored in the memory area. Similarly, a third type of printing data $DA_3$, partition tag data $DB_3$ and tag number data $DC_3$ are stored following the tag number data $DC_2$. In the embodiment disclosed, data indicating all types of printing information are prestored. However, alternatively, the second type of printing information may be entered and printed after the first type printing information is entered and printed.

The mode of operation of the continuous tag printing apparatus will now be described. The pulse motor 28 is driven and the strip 10 is fed by the feed mechanism 27. The photoelectric sensor 36 detects the aperture 13 of each of the tags 11 of the strip 10. When a detection signal is produced by the photoelectric sensor 36 and the pulse motor 28 is then driven through a predetermined number of steps, a check is made to determine if the printing head 24 is aligned on the first column of the tag 11 (i.e., the printing position of the leftmost column of the information 12 in FIG. 4). Information 12 corresponding to the first type of printing data $DA_1$ is printed. Every time the information 12 corresponding to the first type of printing data $DA_1$ is printed on an individual tag 11, the count in tag counter 63 is increased by one. When the count of the tag counter 63 coincides with the content of the tag number data $DC_1$, the tag counter 63 is cleared or reset. Printing of the information 12 corresponding to the second type of printing data $DA_2$ is then started. Similarly, the information 12 corresponding to the third type of printing data $DA_3$ is thereafter printed. Thus, all the types of information 12 are printed on the corresponding predetermined number of tags 11.

During the printing operation, the cutting mechanism 31 is operated in accordance with the detection of one of the apertures 13. The presence of the aperture 13 is detected by the photoelectric sensor 36 (which may alternately be arranged in the vicinity of the cutting mechanism 31 or at any other appropriate location). The cutting mechanism 31 then cuts the strip 10 at every cutting position C so as to obtain individual tags 11. The tags 11 are fed by the delivery rollers 34 and are sequentially stacked in stacker 35.

Figure 9:
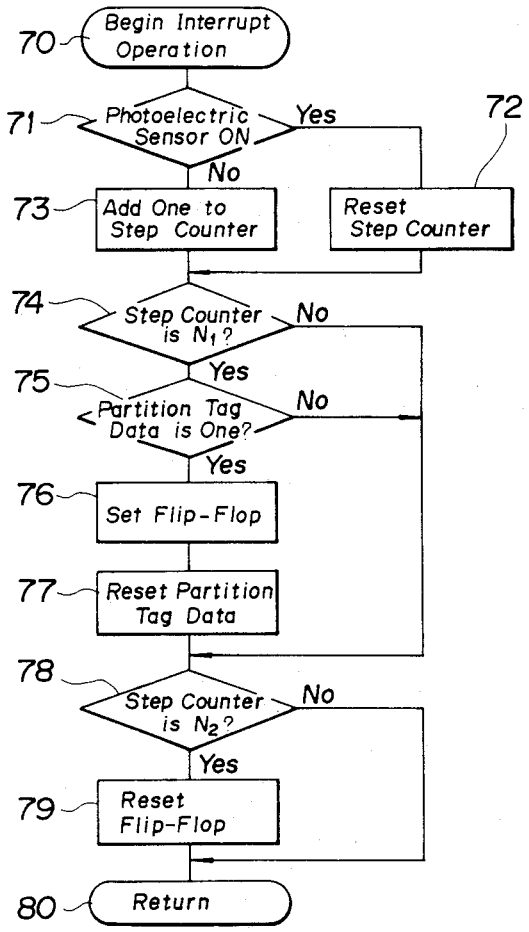

The operation of the mark applying mechanism 37 for applying a mark on the side surface 15 of the strip 10 every time the printing contents change will be described with reference to the flow chart in FIG. 9.

In step 70, an interrupt operation is initiated every time the pulse motor 28 has been operated for a predetermined number of steps. It is then determined in step 71 whether or not the photoelectric sensor 36 is producing an output signal (indicating the presence of a hole 13). If the sensor 36 is producing an output signal, the step counter 64 is reset (see step 72). In this condition, although the ink roller 40 is located at a position where the mark can be applied to the side surface 15 corresponding to the cutting line C of the strip 10, no mark is applied thereto. The mark application is started when the count of the step counter 64 reaches the fixed reference value $N_1$, and the mark application is ended when the count thereof reaches the fixed reference value $N_2$ to be described later. However, if the sensor 36 is not producing an output signal, the step counter 64 is incremented by one. See step 73.

Proceeding to step 74, a determination is made as to whether or not the count of the step counter 64 coincides with the fixed reference value $N_1$ of the permanent memory area 60. It should be noted that the fixed reference value $N_1$ is set as N/8 (wherein N is the unit number of steps of the pulse motor 28 required to feed the strip 10 by a length L of a single tag). If the count in counter 64 does coincide with the fixed reference value $N_1$, the process proceeds to step 75 wherein it is determined whether or not the partition tag data $DB_1$ corresponding to the printing data $DA_1$ during the printing operation is set at logic level "1" (this would indicate that the next tag is the first tag which will contain the new information). If so, the flip-flop 56 is set (step 76) and the partition tag data $DB_1$ is reset to the logic level "0" (step 77). When the flip-flop 56 is set, the solenoid 38 is energized, and the ink roller 40 is brought into tight contact with the side surface 15 of the strip 10, as indicated by the solid line in FIG. 4. In this case, the ink roller 40 is brought into tight contact with a portion of the strip 10 corresponding to a position spaced apart by L/8 from the leading end of the first one of the tags 11 having the changed information printed thereon. When the printing head 24 starts printing the first such tag 11, the ink roller 40 is located at an immediately preceding tag (see FIG. 4). In this printing position, the positional relationship between the printing head 24 and the ink roller 40 is set such that the ink roller 40 has already passed through a position corresponding to the length L/8 inches of the immediately preceding tag 11. Therefore, the mark is not applied to the immediately preceding tag 11.

Proceeding to step 78, the process determines whether or not the count of the step counter 64 concides with the reference fixed value $N_2$ of the permanent memory area 61. If so, the flip-flop 56 is reset (step 79) and the process then proceeds to step 80. If not, the process proceeds directly to step 80. It should be noted that the fixed reference value $N_2$ is set to be 7N/8.

When the count of the step counter 64 coincides with the fixed reference value $N_2$, the ink roller 40 is located at a position corresponding to a distance from the leading end of the tag 11 which corresponds to 7L/8. In this condition, the flip-flop 56 is reset to de-energize the solenoid 38. As a result, the ink roller 40 is pivoted to separate from the side surface of the strip 10 as indicated in phantom in FIG. 4. However, when the count of the step counter 64 does not coincide with the fixed reference value $N_2$, the pulse motor 28 is driven by the predetermined number of steps, and process steps 70 to 80 are repeated. During this operation, the ink roller 40 is held in tight contact with the side surface of the strip 11 and continues to perform printing. It should be noted that the mark is not applied by the ink roller 40 to a portion corresponding to the second and subsequent tags having the same printing contents since the partition tag data $DB_1$ is set at logic level "0".

The second type printing data $DA_2$ and the third type printing data $DA_3$ are printed in the same manner as the first type printing data $DA_1$.

Figure 6:
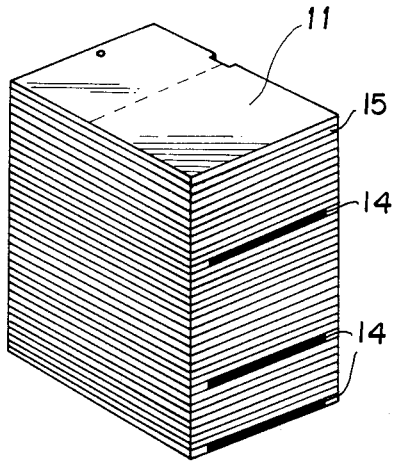

The tags 11 thus obtained are stacked as shown in FIG. 6. In this case, the partition tag having a mark on its side surface can be readily distinguished from the regular tags. As a result, a change in printing contents can be visually confirmed.

In the above embodiment, the first tags having the new information printed thereon have a mark applied thereto. However, the mark may alternatively be placed on the last tag having the old information thereon or a non-printed tag may be formed every time the printing contents change and may have a mark applied thereto, thereby forming a non-printed partition tag. The ink roller 40 is used as the mark applying member in the above embodiment. However, an ink pad, a felt pen or a color pencil may be used in place of the ink roller 40. The ink application time and the length of the mark may be arbitrarily determined. In addition, such marks may be respectively applied to two sides of the strip.

In summary, according to the continuous tag printing apparatus of the present invention, a mark is applied to a side surface of a portion of the strip which corresponds to the prospective partition tag for indicating a change in printing contents. The strip will not be wasted. Furthermore, the obtained tags all have the same length, thereby providing simple alignment and storage of the tags.

The present invention may be embodied in other specific forms without departing from the spirit or essential attributes thereof and, accordingly, reference should be made to the appended claims, rather than to the foregoing specification as indicating the scope of the invention.

What is claimed is:

1. A continuous tag printing apparatus, comprising:

a feed mechanism for feeding a strip of tags in a feed direction along a feed path;

a printing mechanism along the feed path for printing desired information on each of the tags; and a mark applying mechanism along the feed path and disposed in the feed direction from the printing mechanism for applying a mark on a portion of a side surface of the strip at a location which corresponds to a portion of the strip at which information being printed on the tags changes.

2. The continuous tag printing apparatus of claim 1, further including a tag cutting mechanism along the feed path and disposed in the feed direction from the mark applying mechanism for cutting said strip of tags into individual strips, each of identical length.

3. The continuous tag printing apparatus of claim 2, further including a stacking mechanism along the feed path and disposed in the feed direction from the tag cutting mechanism for stacking said individual tags after they have been cut by said cutting mechanism.

4. The continuous tag printing apparatus of claim 3, wherein said stacking mechanism stacks said cut tags in such a manner that each mark applied to one of said cut tags by said mark applying mechanism can be viewed from a side surface of said stack.

5. The continuous tag printing apparatus of claim 1, wherein said printing mechanism applies first printing information to a first plurality of said tags and then applies second printing information to a second plurality of tags, said first printing information being different than said second printing information and wherein said mark applying mechanism applies a mark on a portion of a side surface of the last tag of said first plurality of tags.

6. The continuous tag printing apparatus of claim 1, wherein said printing mechanism applies first printing information to a first plurality of said tags and then applies second printing information to a second plurality of tags, said first printing information being different than said second printing information and wherein said mark applying mechanism applies a mark on a portion of a side surface of the first tag of said second plurality of tags.

7. The continuous tag printing apparatus of claim 1, wherein said mark applying mechanism includes a mark applying member movable between a first position remote from said side surface of said strip and a second position in contact with said side surface of said strip.

8. The continuous tag printing apparatus of claim 7, wherein said mark applying mechanism further includes means for moving a mark applying member between said first and second positions as a function of the movement of said strip past said mark applying mechanism.

9. The continuous tag printing apparatus of claim 8, wherein said mark applying member comprises a roller, said roller being rotatable about a first axis and wherein said feed mechanism feeds said strip past said roller with the major plane of said strip lying at an oblique angle to said axis.

10. The continuous tag printing apparatus of claim 1, further comprising:

control means for providing the information to be printed to the printing mechanism and for controlling the mark applying mechanism, the control means being operable for changing the information provided to the printing mechanism and for controlling the mark applying mechanism to apply a mark when the information provided to the printing mechanism is changed.

* * * * *